US007682668B2

(12) United States Patent
Döhring

(10) Patent No.: US 7,682,668 B2
(45) Date of Patent: Mar. 23, 2010

(54) DECORATIVE PAPER COMPRISING ELECTRICALLY CHARGED FIBERS

(75) Inventor: Dieter Döhring, Lampertswalde (DE)

(73) Assignee: Kronospan Technical Co. Ltd., Nicosia (CY)

( * ) Notice: Subject to any disclaimer, the term of this patent is extended or adjusted under 35 U.S.C. 154(b) by 576 days.

(21) Appl. No.: 10/598,389

(22) PCT Filed: Nov. 19, 2004

(86) PCT No.: PCT/EP2004/053016

§ 371 (c)(1),
(2), (4) Date: Aug. 25, 2006

(87) PCT Pub. No.: WO2005/080096

PCT Pub. Date: Sep. 1, 2005

(65) Prior Publication Data

US 2007/0184244 A1 Aug. 9, 2007

(30) Foreign Application Priority Data

Feb. 25, 2004 (DE) ..... 20 2004 003 061 U

(51) Int. Cl.
*B05D 1/16* (2006.01)

(52) U.S. Cl. ..... 427/462; 427/470

(58) Field of Classification Search ..... 427/462, 427/470

See application file for complete search history.

(56) References Cited

U.S. PATENT DOCUMENTS

| | | | | |
|---|---|---|---|---|
| 4,473,613 | A | 9/1984 | Jaisle et al. | |
| 5,609,966 | A | 3/1997 | Perrin et al. | |
| 6,413,591 | B1 * | 7/2002 | Dettling et al. | 427/462 |
| 6,517,674 | B1 * | 2/2003 | Das | 162/135 |
| 2003/0138600 | A1 | 7/2003 | Döhring et al. | |
| 2004/0096649 | A1 * | 5/2004 | Nissinen et al. | 428/330 |

FOREIGN PATENT DOCUMENTS

| | | |
|---|---|---|
| CN | 1044965 | 8/1990 |
| CN | 1358247 | 7/2002 |
| EP | 0 525 790 | 2/1993 |
| EP | 0 732 449 | 9/1996 |
| WO | 00/44576 | 8/2000 |
| WO | 00/44984 | 8/2000 |

OTHER PUBLICATIONS

International Preliminary Report on Patentability.
English language translation of an excerpt of a Chinese Office Action.

* cited by examiner

*Primary Examiner*—Frederick J Parker
(74) *Attorney, Agent, or Firm*—Renner, Otto, Boisselle & Sklar, LLP

(57) ABSTRACT

The invention relates to a method and an apparatus for the production of décor paper (7) having an abrasion-resistant surface. The production method includes applying a coating of abrasion resistant particles and resin to the décor paper, followed by applying electrically charged fibers onto the coating. The invention further relates to paper made according to said method.

4 Claims, 1 Drawing Sheet

DECORATIVE PAPER COMPRISING ELECTRICALLY CHARGED FIBERS

This application is a national phase of International Application No. PCT/EP2004/053016 filed Nov. 19, 2004 and published in the German language.

TECHNICAL FIELD

The invention relates to a method and an apparatus for the production of paper with abrasion resistant surface as well as a paper produced according to this method.

BACKGROUND

U.S. Pat. No. 4,940,503 discloses a method in which abrasion resistant particles are spread alternatively onto a melamine resin impregnated overlay or onto a melamine resin impregnated décor paper. Overlay and décor paper are subsequently pressed together such that a décor paper with abrasion resistant surface is achieved. However, the abrasion resistivity which might be achieved with such a method is relatively low compared to other methods. Further, an overlay, that means a paper, has to be produced separately.

WO 00/44984 A1 discloses a method, in which a special dispersion containing the abrasion resistant particles, as e.g. corundum or silicon carbide, is sprayed onto a décor paper. The décor paper in turn is used in the manufacturing of a laminate flooring panel. With the help of this method, it is admittedly possible to achieve high abrasion resistance values. However, the technical equipment necessary is relatively complex compared to the mere spraying of abrasion resistant particles. The skilled person knows that the abrasion resistant particles applied onto the décor paper have to be covered with an overlay to protect the press if the décor paper is pressed with a board, in order to produce e.g. panels for a laminate flooring or a work top with abrasion resistant surface.

WO 00/44576 A1 discloses a further method, wherein abrasion resistant particles as e.g. corundum are spread onto an impregnated décor paper. After that, fibers are applied together with resin and the layer system is pressed. In this way, a separate production of the décor paper shall be avoided. However, it is problematic to provide a protective layer in this way, which achieves the positive properties of an overlay paper.

It is thus the problem to be solved by the invention to provide an abrasion resistant paper with improved properties.

DISCLOSURE OF INVENTION

The problem is solved by a method wherein the abrasion resistant particles are applied onto a paper. After that, fibers are electrostatically charged. The fibers are applied onto the paper in electrically charged condition. In this way, it is relatively easy to apply fibers onto the paper in a controlled manner. All or at least most of the fibers are positioned upright with respect to the paper. Thus, it is possible to achieve a regular distribution of the fibers. The result is a paper which has abrasion resistant particles applied onto the surface. Further, upright standing fibers are provided on the paper surface, which is provided with the abrasion resistant particles.

To apply fibers to the paper in electrically charged condition, for example a spreader roll is provided which is supplied with an electrical charge. The spreader roll is provided with recesses or dents on its surface, to receive the fibers. Preferably, the recesses have an irregular shape and are distributed irregularly on the surface of the roll. The fibers are applied from the top onto the spreader roll. The spreader roll is preferably made of electrically insulating material, as e.g. plastic or rubber in order to transfer electrical charge from the roll to the fibers. During rotation of the roll, the fibers finally fall off the roll. The paper containing the abrasion resistant particles is passed underneath the roll. In this way the fibers fall onto the paper and arrange themselves in upright position.

During pressing of the paper in a press, the upright standing fibers lay respectively bent over the abrasion resistant particles. In this way, the press is reliably protected from damage.

As press, in particular such presses are used which work with rotating belts or rollers. In this case, the paper is moved from one side into the press together with the boards. The upright standing fibers are then bent homogenously into one direction. In this way, a homogenous protecting surface is created. The paper pressed with the board is moved out of the press at some other location. The board provided with the paper has an abrasion resistant surface. The such-produced product may be used as a worktop. If necessary, the board may be cut into separate elements, which have a predetermined desired size. The single elements may now be provided with coupling elements on their sides, to produce panels for flooring.

Usually, the paper is provided with a décor. To achieve this aim, the paper may be printed with a pattern. The abrasion resistant particles are then provided on the décor, that means on the printed surface. The paper is moved together with the board into the press, such that the décor is visible. In this case, the material of the fibers is chosen such that the fibers do practically not obstruct the view of the décor The fibers may consist of polyester. On the one side, this makes it possible to provide the fibers with an electrical charge. On the other side, a décor is still visible through these fibers.

Although polyester has the desired properties for the above mentioned purpose, this material is relatively expensive.

To produce more cost efficiently, it is therefore preferred to use cotton linters. Cotton linters are very short fibers, that accrue in the production and extraction of cotton and which cannot be spun. This waste product can also be provided with an electrical charge. Further, a transparent protection layer may be provided such that a décor of an underlying paper remains visible.

The length of the fibers may be in the range of half a millimeter. However, the fibers may be 2-4 mm.

To ensure that the fibers are uniformly distributed from the roll to the paper, the same are preferably brushed out of the recesses of the spreader roll. For this reason, in particular adjacent the spreader roll a further roll is provided, which is provided with bristles. That roll provided with bristles also rotates and thus brushes the fibers out of the recesses of the spreader roll.

To ensure the desired dosage, in one embodiment a doctor blade engages the spreader roll, which holds excess fibers back. During the spreading of fibers preferably funnels are provided on the sides of the paper to receive excess fibers and to recirculate them back to the spreader roll. By means of this recirculation, costs may be reduced.

In one embodiment, electrically charged fibers, which are applied to paper or which are supposed to be applied to paper, are provided with a resin, in particular with a melamine resin to provide for the desired surface properties. Usually insensitivity against stains as well as chemicals is required. Further, melamine resin protects the surface very well against moisture.

In one embodiment of the invention, the abrasion resistant particles are applied onto the paper together with the resin.

Such a method is generally known from the WO 00/44984 A1. At the beginning, the paper is preferably impregnated with a resin and in particular with a melamine resin or a mixture of a melamine resin and a urea resin, to improve the adhesion of the abrasion resistant particles on the paper. Advantageously, excess resin is recirculated back into the container, in which the abrasion resistant particles are stored together with the resin. By recirculating the resins on the one hand costs are effectively cut. More important is, however, that by recirculating a resin, a flow is created in the container. This flow contributes to the effect that the abrasion resistant particles are kept in suspension. In this way, a uniform distribution of the particles in the resin is improved. In this way, also relatively large abrasion resistant particles may be processed.

After spraying the abrasion resistant particles together with the resin onto the paper, in one embodiment of the invention the same is advantageously dried. By drying a molecular enlargement is achieved, namely a condensation polymerization. Thus, a first layer is created on the paper. At this moment electrically charged fibers applied onto these layers cannot impregnate into this layer. If the fibers would penetrate this first layer, said fibers would not any longer be available for the desired protection of the press. Thus, the predrying contributes to the effect that the fibers may provide the desired protective effect.

According to the invention, in an advantageous alternative embodiment, abrasion resistant particles are spread onto impregnated décor paper. The abrasion resistant particles are in particular enclosed by an adhesion promoter, to achieve good abrasion values. After that, electrically charged fibers are applied onto the décor paper.

Preferably, the paper is impregnated with a resin and in particular by means of metering rollers. Alternatively the impregnation may also applied by means of a doctor blade. By means of a resin, respectively by means of the impregnation the abrasion resistant particles are fixed onto the paper.

By spreading the abrasion resistant particles, a more homogenous distribution of the abrasion resistant particles is achieved compared to the spraying method as known from the WO 00/44984 A1. Additionally, the amount of equipment necessary is reduced. The enclosing of the particles with an adhesion promoter is very simple, since the particles only have to be dipped for some time into a corresponding bath. Technically, this is substantially less complex compared to the equipment necessary according to the WO 00/44984A1.

For particularly reliable metering of the abrasion resistant particles, the particles provided with the adhesion promoter are preferably dried before the spreading. In dried condition, and thus in a particularly easy-to-meter condition, the adhesion promoter encloses the abrasion resistant particles in particular completely to achieve thus particularly good abrasion values. To achieve this aim, the abrasion resistant particles are first dipped into a liquid, which consists essentially of the adhesion promoter. Alternatively, the abrasion resistant particles are sprayed with the adhesion promoter. This is still less complex compared to the effort necessary according to the WO 00/44984 A1, since the metering and the recirculation has not to be considered. After that, the particles are dried and are now particularly well-suited for application. The dried particles, which are provided with an adhesion promoter, are spread onto the paper and in particular onto a décor paper. Preferably, a roller is applied for the spreading, which is provided with recesses which are preferably distributed non-homogenously. The depth of the recesses, however, is substantially the same. The abrasion resistant particles provided with the adhesion promoter are spread from the top onto the roller and arrive thus in the recesses. Excess material, that means excess abrasion particles which are provided with an adhesion promoter, is swept off by means of a doctor blade. After that the rotating roller contacts a brush, which sweeps the abrasion resistant particles which are provided with an adhesion promoter from the roller.

The brush is preferably provided in the form of a rotating roller, which is provided with bristles, to sweep the particles provided with an adhesion promoter evenly from the spreader roll. In this way, the abrasion resistant particles are spread homogenously onto the décor paper and in particular preferred in an amount of 18-25 g/m$^2$ depending on the desired abrasion class. The grain size is preferably 90-130 μm in diameter. If the diameter is chosen smaller, a relatively large amount of abrasion resistant particles together with adhesion promoter is consumed. If the diameter is chosen larger, the abrasion resistant particles might damage the press in spite of the fiber containing protective layer.

Before the abrasion resistant particles are spread onto the paper, in a preferred embodiment the respective paper webs are passed through in particular a melamine resin or a mixture containing melamine resin. By means of the adhesion promoter it is possible to integrate the abrasion resistant particles, as e.g. corundum particles or silicon carbide into the resin matrix. If that is not the case, visible boundary layers may remain between the abrasion resistant particles and the resin respectively the resin matrix, which leads to a grey appearance. If no adhesion promoter is applied, the abrasion resistant particles may be pulled out from the matrix, which leads to low abrasion values.

When the paper with the applied abrasion resistant particles as well as with the applied electrically charged fibers is pressed which a further layer, e.g. a panel, the surface temperate during the pressing is preferably between 180-185° C. Usually, a pressure of 20-35 bar is applied. The given temperature is advantageous to cure the resin material. The given pressure is advantageous to keep water, which is contained in the layer system, in liquid form. Otherwise, it would escape in gaseous form and create a rough surface. By means of the high pressure, further a very homogenous surface is provided.

Particularly preferred, the décor paper has a mass of 20-60 g/m$^2$, to achieve a low consumption. The décor paper is preferably filled with acrylate or with an acrylate containing dispersion to further reduce the amount of relatively expensive melamine resin necessary for the impregnation. The acrylate respectively the dispersion is pressed into the décor paper in particular from both sides, to secure that the same penetrates into the interior of the paper. WO 02/079571 A1 discloses suitable compositions as well as a method to bring the acrylate, respectively the dispersion into the interior of the paper in the sense of the present invention. During the spreading of the abrasion resistant particles, preferably funnels are provided on the sides of the paper, to receive excess abrasion resistant particles. In this way, the recycling of abrasion resistant particles is possible, as far as the same are spread in excess to the side of the paper. In particular corundum or aluminum oxide particles to be spread are provided with an adhesion promoter since materials as e.g. silicon carbide do integrate relatively easily in a resin matrix anyway. Silicon carbide, however, has the disadvantage compared to corundum or aluminum oxide that it consists of dark particles which are in particular with bright décors well visible. Thus, usually silicon carbide is not suitable for optical reasons.

During impregnation of the décor paper, typically 100-120 wt. % of resin in relation to the décor paper is provided. Thus, if the mass per unit area of the décor paper is 100 g/m$^2$, an amount of 100-120 g of resin is used. If, however, décor paper with a weight of merely 30 g/m$^2$ is provided and if acrylate respectively an acrylate containing dispersion is pressed into the paper, the amount of resin needed for an impregnation may be reduced to 45-55 wt. %.

Instead of melamine resin, also mixed resins may be used. Typically, such a mixed resin may consist of 70-80 wt. % urea resin and 20-30 wt. % melamine resin, in order to reduce the costs for the resin. Décor paper is preferably impregnated with a mixed resin to reduce costs.

The result is a décor paper, whereby the corundum is arranged in one plane after abrasion resistant particles are spread onto the paper. This can be verified by means of a microscope. Further, the advantageously provided adhesion promoter which encloses the abrasion resistant particles may be detected.

As adhesion promoter, promoters based on silane are preferred since said adhesion promoters are particularly well suited to attach on the one hand to the corundum or aluminum oxide and on the other hand to achieve the desired adhesion with the resin used, and thus the desired abrasion resistivity.

Generally, also other adhesion promoters are suitable. However, amino-silane based adhesion promoters have been proven as particularly suitable.

MODES FOR CARRYING OUT THE INVENTION

Figure 1:
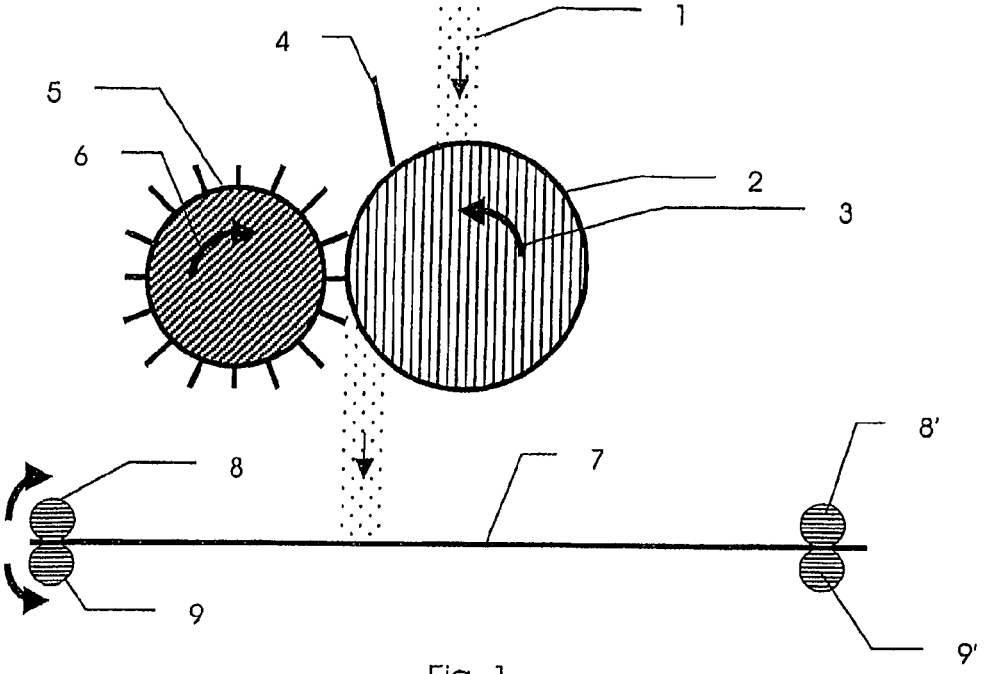
FIG. 1 shows an apparatus for spreading abrasion resistant particles onto a paper.

Abrasion resistant particles 1 made of corundum with a diameter of 90-130 μm have been enclosed by a silane based adhesion promoter and afterwards dried. After that, the abrasion resistant particles are pourable and spread onto a roller 2, as it is shown in a sectional view in FIG. 1. Roller 2 is provided with recesses or dents on its surface (not shown). By slow anticlockwise rotation of roller 2 in the direction of arrow 3, the spread particles are passed to a doctor blade 4, which abuts roller 2 with an open end. By means of the doctor blade 4, it is secured that the abrasion resistant particles 1 fill the recesses in a homogenous and complete manner. From this point on, the abrasion resistant particles are further transported to a fast rotated brush 5 which in the example shown rotates clockwise in direction of arrow 6. Thus, the abrasion resistant particles are fully swept out from the recesses and are metered onto the surface of the décor paper 7. The décor paper 7 is passed underneath the roller by means of suitable rotating rollers 8 and 9. Immediately before that, the décor paper 7 was impregnated with a mixture made of 25 wt. % melamine resin and 74 wt. % urea resin. The décor paper has a mass per unit of 30 g/m$^2$ and is provided in its inside with acrylate. The resin applied during impregnation is 15 g per square meter of paper.

Thus, it is possible to spread the paper in a very homogenous manner with abrasion resistant particles. The abrasion resistant particles abut the side with the printed décor.

After that, fibers 10, which might be impregnated with a melamine resin are spread onto the décor paper in a similar manner as the abrasion resistant particles 1 described above. An apparatus is used which comprises the elements shown in FIG. 1. The components involved in this method step, like e.g. roller, brush and doctor blade consist in this case however of electrically non-conductive materials, as e.g. rubber or plastic. The components involved like roller, doctor blade and/or brush are additionally charged with an electrical load. This leads to the effect that fibers reaching the roller are charged electro-statically. When swept out from the roller, the fibers are accelerated in the direction of the paper. By means of this repulsion effect, the fibers distribute evenly on the paper. They arrange themselves parallel to each other and stand essentially upright on the paper.

During the implementation of the method, preferably a relatively large amount of resin is used during the application of the abrasion resistant particles in comparison to the application of the particles by spraying, and in particular if fibers are applied which were not provided with a resin beforehand. During spraying of the mixture, which contains the resin and the abrasion resistant particles, typically 100-250 wt. % are applied in relation to the mass per unit area of the paper in its dry (raw) condition. In the present case, the amount of resin is chosen in one embodiment of the invention thus that the dry paper is provided with a coating, whose weight is 2-2.5 times higher or more.

Figure 2:
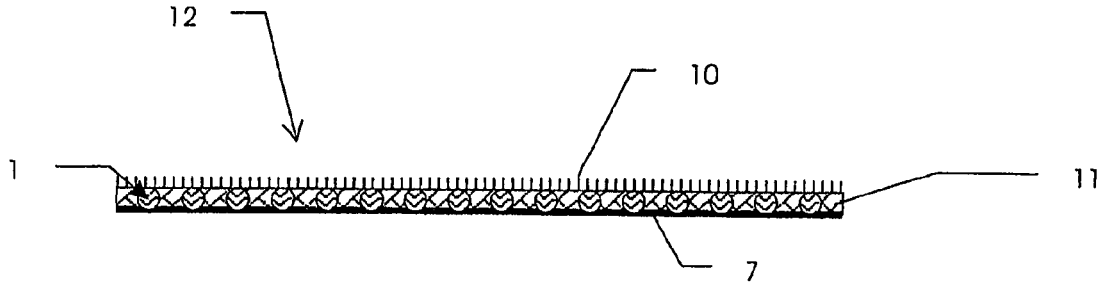
FIG. 2 shows a manufactured paper.
Figure 3:
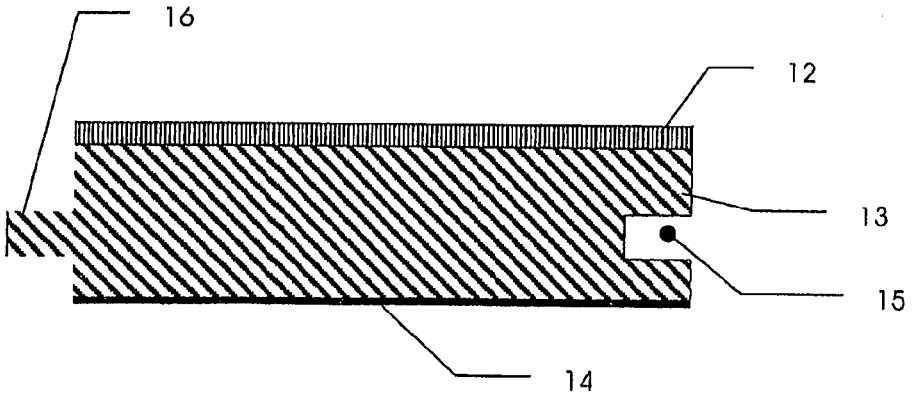
FIG. 3 shows a panel with a manufactured paper.

Once the electrically charged fibers 10 are applied onto a paper, the paper is preferably dried. Thus, a paper is provided which is on the one side provided with abrasion resistant particles and which on the other side is prepared to be used in a press. In FIG. 2, the principle arrangement is shown.

Décor paper 12 provided with an abrasion resistant layer is e.g. pressed with pressures of 30 bars and temperatures of 180° C. together with a base plate 13 made of HDF and a counter acting paper 14. In doing so, the completely or predominantly substantially upright protruding fibers lay themselves over the abrasion resistant particles 1. In this way, the press can be protected from being damaged by the abrasion resistant particles.

After that, panels of desired size of typically 20-40 cm width and a length of typically 80 cm-160 cm are cut and are provided on their sides with coupling elements like e.g. groove 15 or tongue 16. Preferably, groove and tongue are provided with additional locking elements (not shown) to provide a positive lock between two panels, such that a locking parallel to the surface of the panels is provided. Such locking is e.g. known from WO 02/079571 A1.

The counter acting paper has in particular a low basis weight of 20-60 g/m$^2$ and is preferably provided with acrylate and impregnated before the pressing with a urea resin or a mixture which contains predominantly urea resin. Thus, the costs for the application of a counter acting paper is minimized since a comparably low amount and additionally relatively cheap resin is used. The counter acting paper protects a panel or a work plate etc. from distortion.

The invention claimed is:

1. Method for the production of a décor paper having an abrasion resistant coating (1, 11) and fibers, which are mounted onto or at the abrasion resistant coating (1, 11) comprising the steps of:

providing a décor paper;

applying a coating comprising abrasion resistant particles (1) comprising aluminum oxide together with resin onto the décor paper; and afterwards applying electrically charged fibers (10) onto the coating consisting of abrasion resistant particles and the resin, wherein at least a majority of the fibers are in an upright position with respect to the décor paper.

2. Method according to claim 1, wherein the décor paper provided with the fibers (10) is subsequently dried.

3. Method according to claim 1, wherein a mixture of resin and abrasion resistant particles is sprayed onto the décor paper and excess resin is recirculated from the paper to the mixture, wherein after the spraying and before the application of fibers, the paper with the applied layer is preferably dried.

4. Method for the production of a décor paper having an abrasion resistant coating (1, 11) and fibers, which are mounted onto or at the abrasion resistant coating (1, 11), comprising the steps of:

providing a décor paper;

impregnating the décor paper with resin;

providing abrasion resistant particles (1) comprising aluminum oxide with an adhesion promoter;

spreading the abrasion resistant particles onto the paper; and afterwards applying electrically charged fibers (10) onto the coating consisting of abrasion resistant particles and resin, wherein at least a majority of the fibers are in an upright position with respect to the décor paper.

* * * * *